US006652065B2

(12) United States Patent
Nakagawa

(10) Patent No.: US 6,652,065 B2
(45) Date of Patent: Nov. 25, 2003

(54) PRINTING APPARATUS AND CONTROL METHOD THEREFOR

(75) Inventor: Yoshinori Nakagawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/160,009

(22) Filed: Jun. 4, 2002

(65) Prior Publication Data

US 2002/0186276 A1 Dec. 12, 2002

(30) Foreign Application Priority Data

Jun. 7, 2001 (JP) ..... 2001-172741

(51) Int. Cl.[7] ..... B41J 2/165
(52) U.S. Cl. ..... 347/32; 347/14
(58) Field of Search ..... 347/43, 14, 19, 347/32, 37, 23, 33, 29, 30

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,723,129 A | | 2/1988 | Endo et al. | 347/56 |
| 4,740,796 A | | 4/1988 | Endo et al. | 347/56 |
| 6,015,202 A | * | 1/2000 | Hiramatsu et al. | 347/32 |
| 6,352,327 B1 | * | 3/2002 | Yano et al. | 347/14 |

FOREIGN PATENT DOCUMENTS

| | | |
|---|---|---|
| JP | 59-123670 | 7/1984 |
| JP | 6-115097 | 4/1994 |
| JP | 10-309810 | 11/1998 |

* cited by examiner

*Primary Examiner*—Lamson Nguyen
(74) *Attorney, Agent, or Firm*—Fitzpatrick, Cella, Harper & Scinto

(57) ABSTRACT

A printing apparatus and a printing control method are disclosed, which can ensure a sufficient acceleration area for stable movement of a carriage and realize the downsizing. According to the printing apparatus, an inkjet printhead is used, on which a plurality of nozzle arrays each having a plurality of nozzles for discharging ink are arranged in a direction different from the array direction of the nozzles. The apparatus performs printing operation on a printing medium by discharging ink while reciprocally moving the carriage, on which the above inkjet printhead is mounted, in a direction in which the plurality of nozzle arrays are arranged. When preliminary discharge is performed from the inkjet printhead to an ink receptor arranged on at least one end of a reciprocal movement area of the inkjet printhead, the carriage is stopped. The scanning of the carriage is controlled so that the carriage accelerates from zero speed to a predetermined speed after the preliminary discharge is completed, and moves at the predetermined speed. On the other hand, the movement of the carriage and preliminary discharge are so controlled as to sequentially perform preliminary discharge with regard to the plurality of nozzle arrays from one nozzle array arranged outside the reciprocal movement area to another nozzle array arranged inside the area.

9 Claims, 8 Drawing Sheets

PRINTING APPARATUS AND CONTROL METHOD THEREFOR

FIELD OF THE INVENTION

The present invention relates to a printing apparatus and a control method therefor and, more particularly, to a printing apparatus for printing by reciprocally moving a carriage on which an inkjet printhead is mounted and a control method for the printing apparatus.

BACKGROUND OF THE INVENTION

A printing apparatus used as a printing unit for printing an image and the like in a printer, copying machine, facsimile apparatus, or the like, or as a print output device for a composite electronic device or workstation including a computer and word processor is designed to print an image and the like on the printing medium such as a paper sheet or thin plastic plate on the basis of image information (including all output information such as character information).

Such printing apparatuses are classified by their printing methods into an inkjet method, wire dot method, thermal method, electro-photographic method, and the like. Of these methods, the printing apparatus using the inkjet method (to be referred to as an inkjet printing apparatus hereinafter) implements printing by discharging ink from an inkjet printhead to the printing medium. According to this method, high-precision printing operation can be easily and quietly performed at high speed, and the cost can be low as compared to the other printing methods. Furthermore, in recent years, a color output such as a color image becomes more important, and many types of color inkjet printing apparatuses whose image quality is equivalent to halide photography have been developed.

Some of these inkjet printing apparatuses are implemented such that a printhead with a plurality of array-integrated printing elements, orifices, and ink channels is used to increase printing speed, and a plurality of printheads are mounted on a carriage in correspondence with the number of color inks to cope with color printing. These printheads are arranged side by side in the carriage moving direction (to be referred to as a main-scanning direction).

The inkjet printing apparatus intermittently discharges ink so as to always maintain a good ink discharge state independently of printing operation during intervals between printing operations (to be referred to as preliminary discharge). Such preliminary discharge can be performed at various timings. Preliminary discharge is generally performed to an ink receptor which is arranged at the reversing position of the carriage (e.g., a position near the home position of the carriage) during reciprocal movement of the carriage, particularly, when the carriage moving direction reverses.

FIG. 8 is a view showing the relationship between the speed and position of the printhead in the main-scanning direction when preliminary discharge is performed upon reversing the carriage. For the sake of descriptive convenience, consider a case where a nozzle array for discharging black ink (to be referred to as a black nozzle array) and a color nozzle array for discharging color ink (to be referred to as a color nozzle array) are arranged side by side in the main-scanning direction on the printhead mounted on the carriage.

In FIG. 8, reference symbol v denotes the moving speed of the black nozzle array and color nozzle array in the main-scanning direction; x, the position of the black nozzle array and color nozzle array in the main-scanning direction; and Y, a preliminary discharge position (ink receiving position). Reference numeral 301 denotes a solid line indicating the moving speed and position of the black nozzle array; and 302, a dotted line indicating the moving speed and position of the color nozzle array. Reference symbols I1 and I2 denote printing areas; Ie1 and Ie2, end portions of the printing areas; Kd, the deceleration start position of the black nozzle array; Cd, the deceleration start position of the color nozzle array; Ka, the acceleration end position of the black nozzle array; Ca, the acceleration end position of the color nozzle array; Ck, the position of the black nozzle array at a time of the preliminary discharge of the color nozzle array; and Kc, the position of the color nozzle array in the preliminary discharge of the black nozzle array.

With regard to the main-scanning direction, the interval between the color nozzle array and the black nozzle array corresponds to the interval between Cd and Kd. Likewise, the interval between Ck and Y, interval between Y and Kc, and interval between Ca and Ka respectively correspond to the interval between the color nozzle array and the black nozzle array.

The reciprocal movement of the black nozzle array and color nozzle array in the main-scanning direction will be described in detail below with reference to FIG. 8.

(1) In a constant speed movement zone on the right side (area I2) of Ie2, or on the right side (area I1) of Ie1, printing operation is performed by using the black nozzle array and color nozzle array.

(2) With regard to a backward movement, the black nozzle array moves at a constant speed between Ie1 and Kd, and the color nozzle array moves at the constant speed between Ie1 and Cd.

(3) With regard to the backward movement, the black nozzle array decelerates between Kd and Y, and the color nozzle array decelerates between Cd and Ck.

(4) The black nozzle array stops at Y, and the color nozzle array stops at Ck, from the start to the end of the preliminary discharge operation of the black nozzle array.

(5) The moving direction of the carriage is reversed, and then the forward movement is started from this point. The black nozzle array moves between Y and Kc, and the color nozzle array moves between Ck and Y, in the forward direction until the color nozzle array reaches the position where preliminary discharge can be performed, i.e., an ink receptor's position, accompanied with slight acceleration and deceleration.

(6) The black nozzle array stops at Kc, and the color nozzle array stops at Y, from the start to the end of the preliminary discharge operation of the color nozzle array.

(7) With regard to the forward movement, the black nozzle array accelerates between Kc and Ka, and the color nozzle array accelerates between Y and Ca. Note that Ka and Ie2 indicate the same position.

(8) With regard to the forward movement, the color nozzle array moves at a constant speed between Ca and Ka. In this case, since the black nozzle array has reached the end portion Ie2 of the print area, the black nozzle array performs printing operation while moving at the constant speed.

(9) With regard to the forward movement, the color nozzle array also moves at the constant speed and performs printing operation after reaching the end portion Ie2 of the print area.

In performing preliminary discharge according to the above procedure when the moving direction of the carriage is reversed, the carriage may not achieve sufficient acceleration in the acceleration regions, (Y–Ca) and (Kc–Ka). If the carriage cannot accelerate sufficiently, the carriage cannot move at a desired speed or the constant speed or may vibrate, even when the carriage reaches the print area, thus posing a problem.

In order to solve the problem, the acceleration regions may be extended so that the carriage can achieve sufficient acceleration. This, however, results in an increase in the width of the printing apparatus main body.

For example, Japanese Patent Publication Laid-Open No. 6-115097 discloses an arrangement where the ink receptor for preliminary discharge is set at the accelerate/decelerate start position of the carriage. In the arrangement where two arrays of the printheads are juxtaposed in the main-scanning direction, when the ink receptor does not have a sufficient width for the simultaneous preliminary discharge of the two arrays of printheads, the above problem may occur depending on the order of preliminary discharge.

Japanese Patent Publication Laid-Open No. 10-309810 discloses a technique of performing preliminary discharge while moving the carriage. In order to discharge ink to the ink receptor for preliminary discharge correctly, the number of ink droplets for the preliminary discharge must be limited, or the ink receptor with a width corresponding to the required number of the ink droplets must be installed. If preliminary discharge is not sufficiently performed, print quality deteriorates. If a sufficient width for discharging ink is provided, the width of the printing apparatus main body becomes large.

As described above, in the prior art, when the preliminary discharge is performed when the moving direction of the printhead is reversed, the above drawbacks remain unsolved.

SUMMARY OF THE INVENTION

Accordingly it is an object of the present invention to provide a printing apparatus and a control method therefor which can ensure a sufficient acceleration area for stable movement of a carriage and achieve downsizing.

According to one aspect of the present invention, the foregoing object is attained by providing a printing apparatus for printing by discharging ink from an inkjet printhead to a printing medium by using the inkjet printhead on which a plurality of nozzle arrays each having a plurality of nozzles for discharging ink are arranged in a direction different from an array direction of the nozzles while reciprocally moving a carriage on which the inkjet printhead is mounted in a direction in which the plurality of nozzle arrays are arranged, comprising: scanning means for reciprocally moving the carriage; an ink receptor, being arranged on at least one end of a reciprocal movement area of the inkjet printhead, for receiving the ink discharged from the inkjet printhead; preliminary discharge driving means for performing preliminary discharge from the inkjet printhead to the ink receptor when a carriage moving direction in the reciprocal movement is reversed by the scanning means; scanning control means for controlling the carriage to stop in the preliminary discharge, accelerate from zero speed to a predetermined speed after the preliminary discharge is completed, and move at the predetermined speed; and control means for controlling movement of the carriage by the scanning means and the preliminary discharge performed by the preliminary discharge driving means such that the preliminary discharge is sequentially performed with regard to the plurality of nozzle arrays from a nozzle array arranged outside the reciprocal movement area to another nozzle array inside the area.

The ink receptor is preferably arranged near the home position of the carriage. Additionally, another ink receptor may be arranged at one end of a reciprocal movement area of an inkjet printhead, which is located on the opposite side to the home position.

The plurality of nozzle arrays may be nozzle arrays for respectively discharging different color inks.

The print area in which the inkjet printhead discharges ink to print is set inside the reciprocal movement area. The distance from the position of the ink receptor to one end of the print area is sufficient for the carriage to reach a predetermined speed.

Additionally, the inkjet printhead preferably includes an electrothermal transducer which is used for generating thermal energy to be applied to the ink in order to discharge the ink by using the thermal energy.

According to another aspect of the present invention, the foregoing object is attained by providing a print control method adapted to a printing apparatus for printing by discharging ink from an inkjet printhead to a printing medium by using the inkjet printhead on which a plurality of nozzle arrays each having a plurality of nozzles for discharging ink are arranged in a direction different from an array direction of the plurality of nozzles while reciprocally moving a carriage on which the inkjet printhead is mounted in a direction in which the plurality of nozzle arrays are arranged and printing, and performing preliminary discharge from the inkjet printhead to an ink receptor arranged on at least one end of a reciprocal movement area of the inkjet printhead, comprising: a preliminary discharge step of performing the preliminary discharge from the inkjet printhead to the ink receptor when a moving direction of the carriage is reversed; a scanning control step of controlling the carriage to stop in the preliminary discharge, accelerate from zero speed to a predetermined speed after the preliminary discharge is completed, and move at the predetermined speed; and a control step of controlling movement of the carriage and the preliminary discharge performed at the preliminary discharge step such that the preliminary discharge is sequentially performed with regard to the plurality of nozzle arrays from a nozzle array arranged outside the reciprocal movement area to another nozzle array inside the area.

In accordance with the present invention as described above, an inkjet printhead reciprocally moves, on which a plurality of nozzle arrays for discharging ink are arranged in a moving direction of a carriage. Preliminary discharge is performed from the inkjet printhead to an ink receptor arranged on at least one end of a reciprocal movement area of the inkjet printhead when the moving direction of the carriage is reversed. The scanning of the carriage is controlled so that when this preliminary discharge is to be performed, the carriage stops, and that the carriage accelerates from zero speed to a predetermined speed after the preliminary discharge is completed, and moves at the constant speed. On the other hand, with regard to the plurality of nozzle arrays, the movement of the carriage and the preliminary discharge are so controlled as to sequentially perform the preliminary discharge from the nozzle array arranged outside the reciprocal movement area to the nozzle array arranged inside the area.

The invention is particularly advantageous since the sufficient acceleration area for stable movement of the carriage can be ensured without extending the carriage acceleration area.

Therefore, the present invention can make the carriage movement stable, keep the image print quality high, and contribute to the downsizing of the printing apparatus.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, sere to explain the principles of the invention.

DETAILED DESCRIPTION OF THE PREFERRED EMBODIMENTS

Preferred embodiments of the present invention will now be described in detail in accordance with the accompanying drawings.

First, a common embodiment will be described below.

Figure 1:
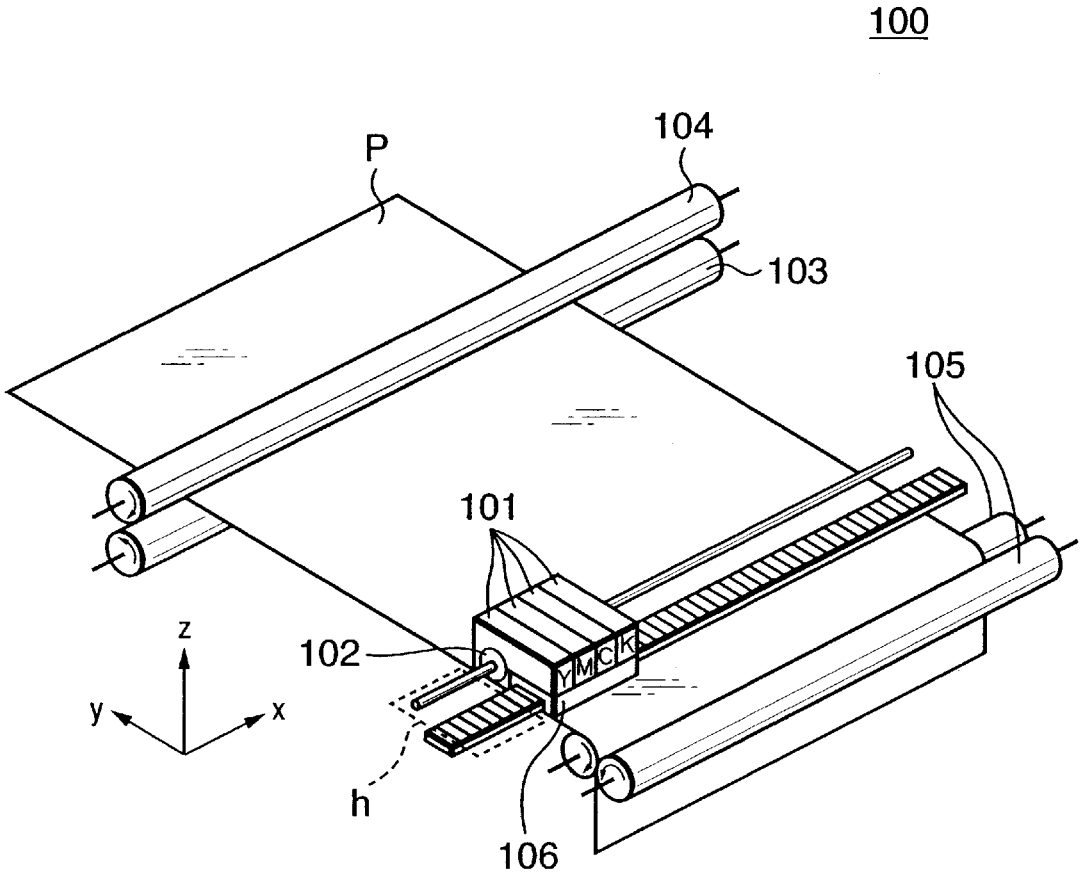
FIG. 1 is a perspective view showing the schematic arrangement of a printing apparatus having an inkjet printhead for printing according to a representative embodiment of the present invention.

FIG. 1 is a perspective view showing the schematic arrangement of a printing apparatus 100 including an inkjet printhead for printing according to a representative embodiment of the present invention.

In FIG. 1, four inkjet cartridges 101 are constituted by ink tanks in which four color inks such as black (K), cyan (C), magenta (M), and yellow (Y) inks are respectively stored, and a printhead 102 having nozzle arrays which correspond to the respective color inks. Hence, the printhead 102 includes the four nozzle arrays in correspondence with the four color inks.

Figure 2:
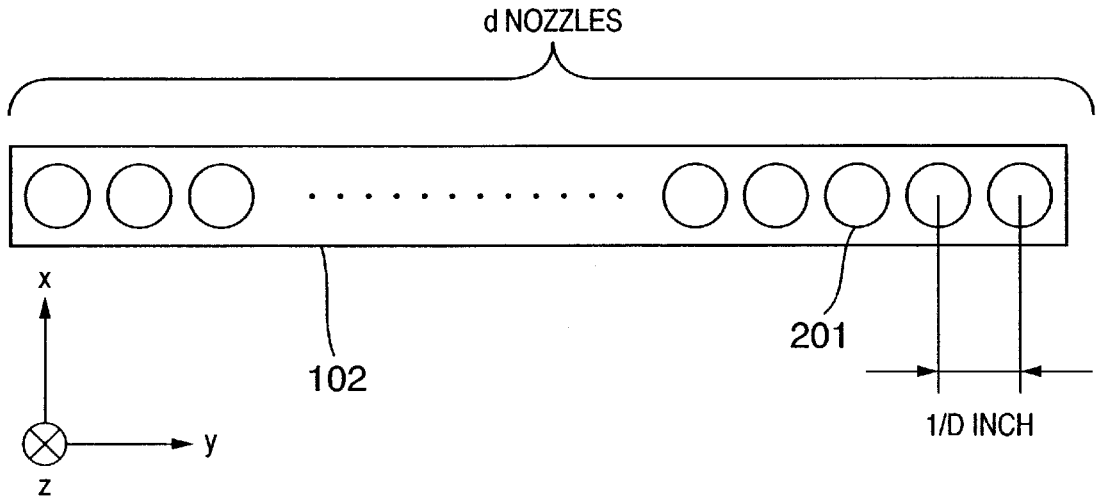
FIG. 2 is a schematic view of an array of orifices arranged on a printhead 102 when viewed from the z direction in FIG. 1.

FIG. 2 is a schematic view showing the array of orifices (to be referred to as nozzles hereinafter) arranged in the printhead 102 when viewed from the z direction in FIG. 1. In FIG. 2, reference numeral 201 denotes d nozzles arranged on each printhead 102 at a density of D nozzles per inch (D dpi).

Referring back to FIG. 1, reference numeral 103 denotes a paper conveyance roller which rotates in the direction indicated by an arrow shown in FIG. 1 while sandwiching a printing medium P together with an auxiliary roller 104, and conveys the printing medium P in the y direction (sub-scanning direction) as needed. Reference numeral 105 denotes a pair of feed rollers which feeds a printing medium. The pair of feed rollers 105 sandwich the printing medium P and rotate like the rollers 103 and 104. Since the pair of feed rollers 105 rotate at lower speed than the paper conveyance roller 103, a tension can be exerted on the printing medium. Reference numeral 106 denotes a carriage for supporting the four inkjet cartridges 101 and moving these inkjet cartridges in printing operation. The carriage 106 is positioned at a home position h which is indicated by the broken line in FIG. 1 when the carriage 106 does not perform printing or executes recovery processing and the like of the printhead 102.

As a type of recovery processing, processing called preliminary discharge is available, which is used to stably discharge ink as described above. The preliminary discharge is performed to avoid a problem that the ink cannot be discharged or the amount and direction of ink discharged become unstable when printing operation is performed using nozzles which have not been used for some time. In this preliminary discharge, for example, ink is discharged to the ink receptor for preliminary discharge during printing operation when the carriage 106 is reversed a predetermined period of time after the last preliminary discharge. This ink receptor is arranged at the position opposing the printhead 102 at the home position h.

A control arrangement for executing the print control of the above apparatus will be described below.

Figure 3:
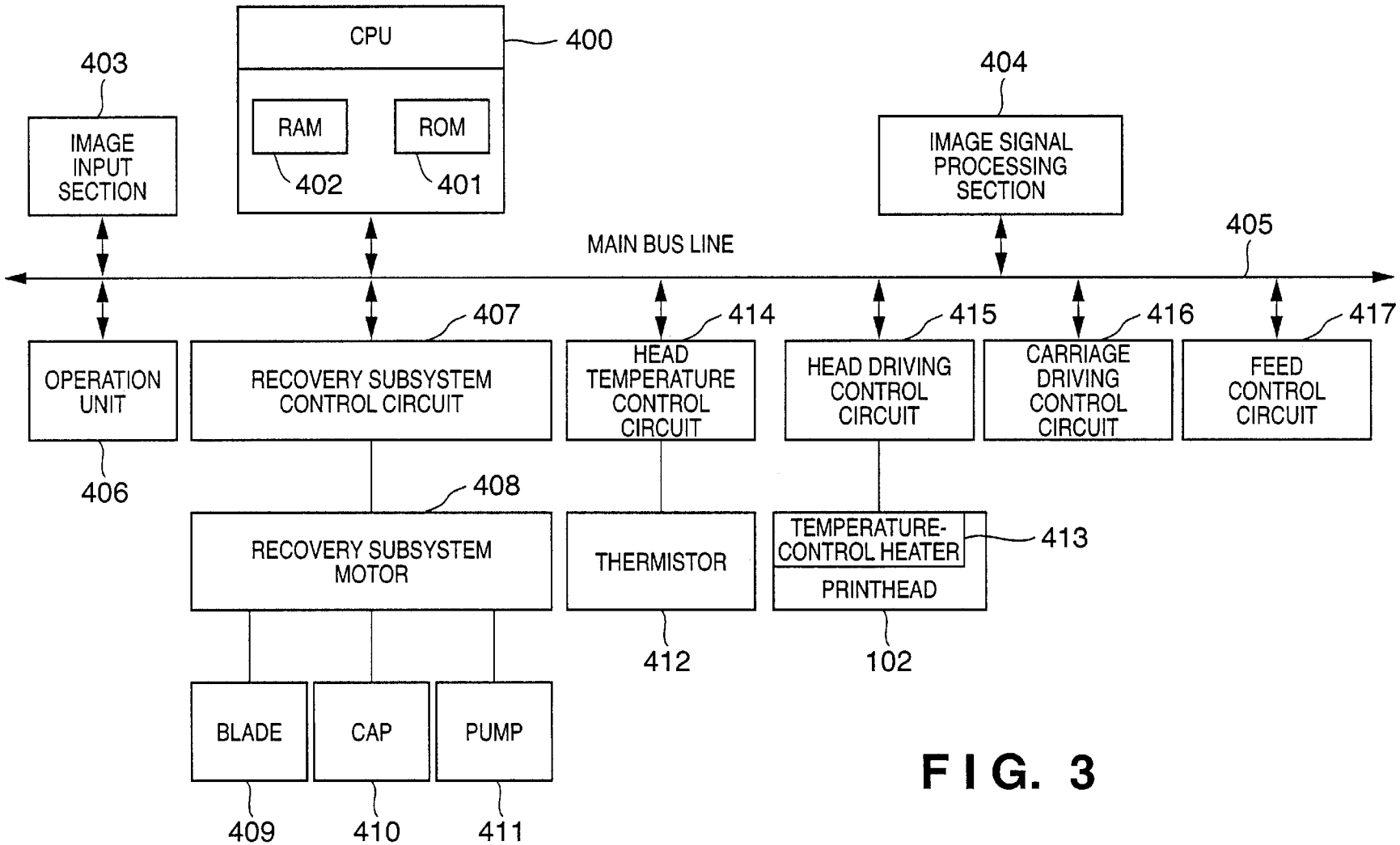
FIG. 3 is a block diagram showing the arrangement of a control circuit of the printing apparatus.

FIG. 3 is a block diagram showing the control arrangement of the inkjet printing apparatus shown in FIG. 1.

In FIG. 3, a CPU 400 controls each device and executes data processing via a main bus line 405. That is, the CPU 400 executes programs stored in a ROM 401 to control data processing, head driving, and carriage driving via the units described later. A RAM 402 is used as a work area for the data processing and the like by the CPU 400. As a type of storage device which is used as a memory, a hard disk and the like are available in addition to the RAM. An image input section 403 has an interface with a host computer, and temporarily holds the image data input from the host computer. An image signal processing section 404 executes data processing such as color conversion and binarization.

An operation section 406 includes keys and the like to allow an operator to input instructions. A recovery subsystem control circuit 407 controls recovery operation such as preliminary discharge in accordance with a recovery processing program stored in the RAM 402. That is, a recovery subsystem motor 408 drives the printhead 102, a cleaning blade 409 which is opposed to and spaced apart from the printhead 102, a cap 410, and a suction pump 411. In general, a head driving control circuit 415 controls driving operation of an electrothermal transducer for discharging ink from the printhead 102 so that the printhead 102 can perform ink discharge for preliminary discharging and printing operation. Similarly, the CPU 400 executes programs to drive a carriage driving control circuit 416 and a feed control circuit 417, thus respectively controlling the movement of the carriage and paper conveyance operation.

On a circuit board in which the electrothermal transducers of the printhead 102 are mounted, a temperature-control heater 413 is arranged to heat and adjust the ink temperature to a desired preset temperature in the printhead. A thermistor 412 is also arranged on the above circuit board to measure the substantial ink temperature in the printhead. The thermistor 412 may be arranged outside the circuit board, e.g., the position near the printhead.

Figure 4:
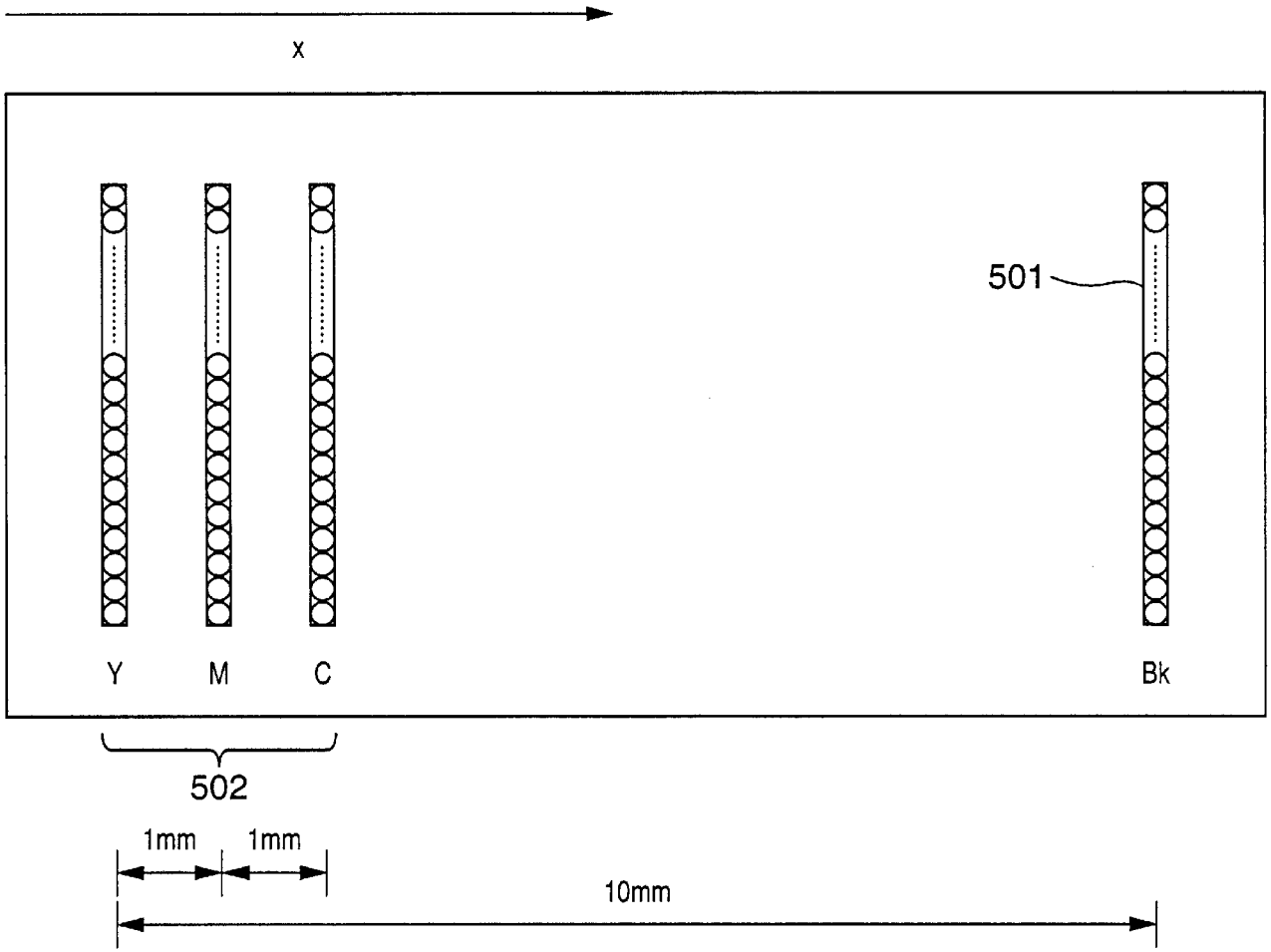
FIG. 4 is a schematic view showing the orifice surface of the printhead 102.

FIG. 4 is a schematic view showing the ink discharge surface of the printhead 102.

As described above, the printhead 102 includes four nozzle arrays corresponding to four color inks. In FIG. 4, reference numeral 501 denotes a nozzle array which discharges black (Bk) ink; and 502, nozzle arrays which respectively discharge cyan (C), magenta (M), and yellow (Y) inks. These three nozzle arrays which discharge the three color inks are called color nozzle arrays, and the nozzle array which discharges the black (Bk) ink is called a black nozzle array.

In this embodiment, each of the black nozzle array and the color nozzle arrays has nozzle pitch (P)=42.4 $\mu$m, number of orifices d=128 (128 nozzles), and length of the printhead=5.42 mm. With regard to the relationship between the positions of the black nozzle array and color nozzle array in the x direction, the black nozzle array is positioned upstream (print area side) in the x direction, and the color nozzle array is positioned downstream (home position side (ink receptor side)). The interval between the black nozzle array and the yellow nozzle array is 10 mm. Both of the intervals between the cyan nozzle array and the magenta nozzle array, and the magenta nozzle array and the yellow nozzle array are 1 mm in the x direction. The interval between the cyan nozzle array and the yellow nozzle array is 2 mm in the x direction.

On the other hand, an ink receptor for the preliminary discharge (to be referred to as an ink receptor hereinafter) has a width of 5 mm in the x direction. Hence, preliminary discharge can be simultaneously performed from the cyan, magenta, and yellow nozzle arrays, but preliminary discharge cannot be simultaneously performed from the black nozzle array and color nozzle arrays. Therefore, preliminary discharge must be performed from the black nozzle array and color nozzle arrays with a time difference.

Some embodiments using the above apparatus will be described below.

First Embodiment

In the printhead with the above arrangement, when preliminary discharge is performed in the order of the black nozzle array and color nozzle arrays, the carriage may not sufficiently accelerate as described above. Hence, in this embodiment, preliminary discharge is performed in the order of the nozzle positioned on the ink receptor side, i.e., the color nozzle arrays, and the black nozzle array.

Figure 5:
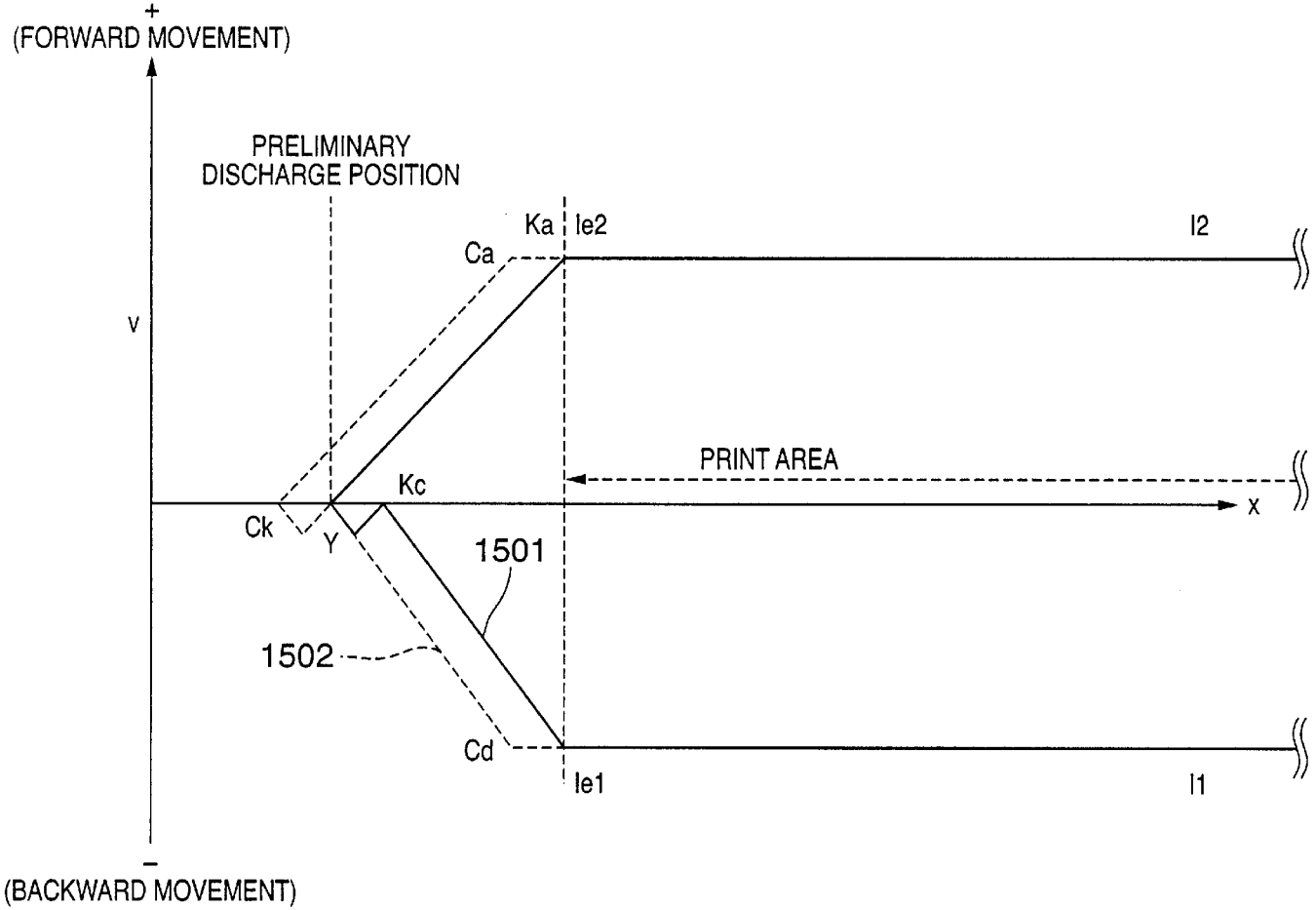
FIG. 5 is a view showing the relationship between the speed and position of the printhead in a main-scanning direction in performing preliminary discharge when a carriage movement is reversed according to a first embodiment of the present invention.

FIG. 5 is a view showing the relationship between the speed and position of the printhead in the main-scanning direction in performing preliminary discharge when the carriage movement is reversed.

Figure 8:
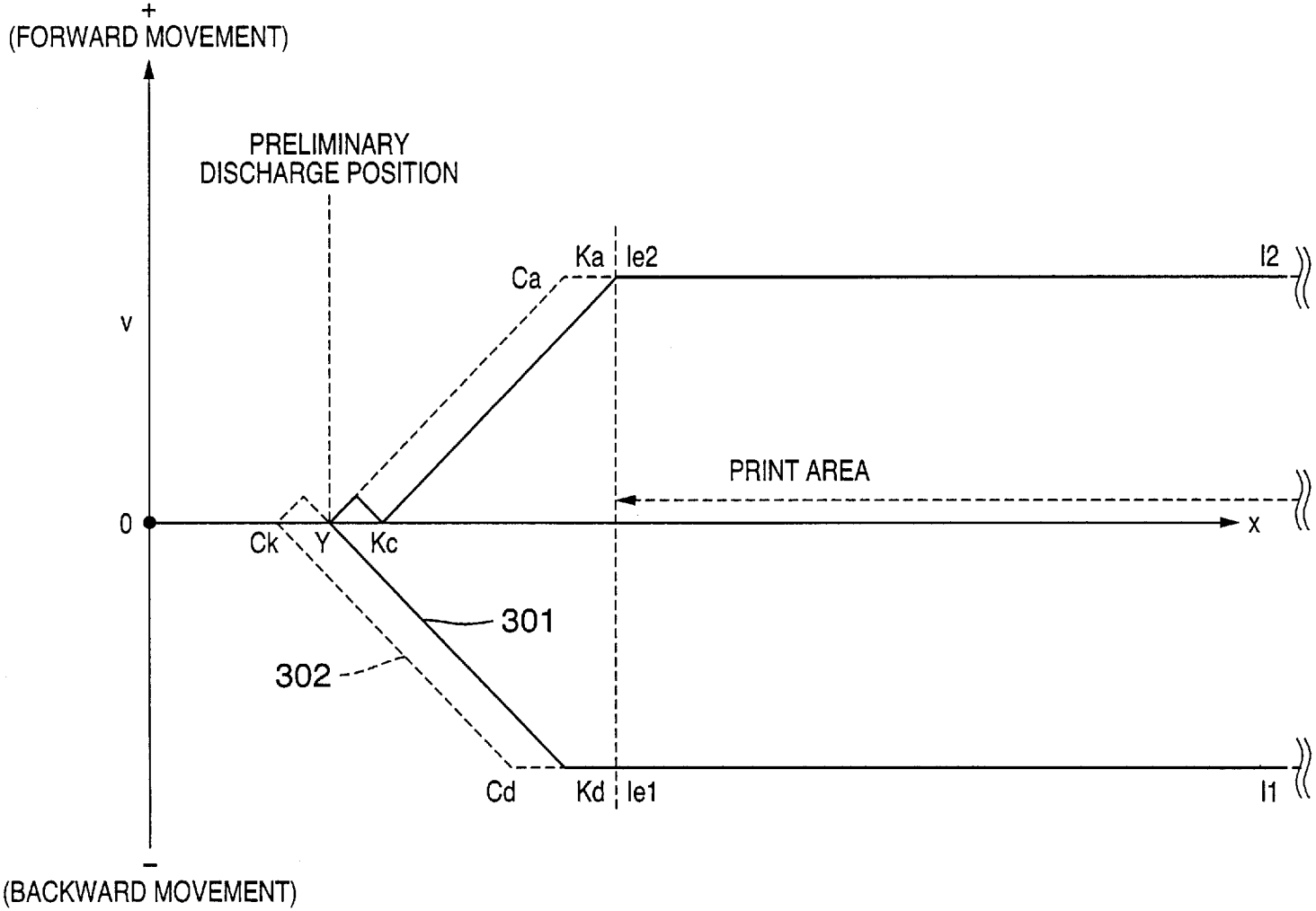
FIG. 8 is a view showing the relationship of the speed and position of the printhead in the main-scanning direction in performing preliminary discharge when the carriage movement is reversed according to the prior art.

In FIG. 5, reference symbols x, v, I1, I2, Ie1, Ie2, Kd, Cd, Y, Ka, Ca, Ck, and Kc denote the same as those in FIG. 8 described above, and a description thereof will be omitted. As is obvious from the arrangement of the printhead 102, the color nozzle arrays include the cyan, magenta, and yellow nozzle arrays, which simultaneously perform the preliminary discharge. Hence, in FIG. 5, the position of the yellow nozzle array is indicated as the representative position of the color nozzle arrays. Reference numerals 1501 and 1502 respectively denote a solid line for indicating the moving speed and position of the black nozzle array, and a dotted line for indicating the moving speed and position of the color nozzle array.

In consideration of the arrangement of the plurality of nozzle arrays shown in FIG. 4, an interval of 10 mm between the yellow nozzle array (color nozzle arrays) and the black nozzle array in the main-scanning direction corresponds to each of the intervals between Cd and Kd, between Ck and Y, between Y and Kc, and between Ca and Ka.

Figure 6:
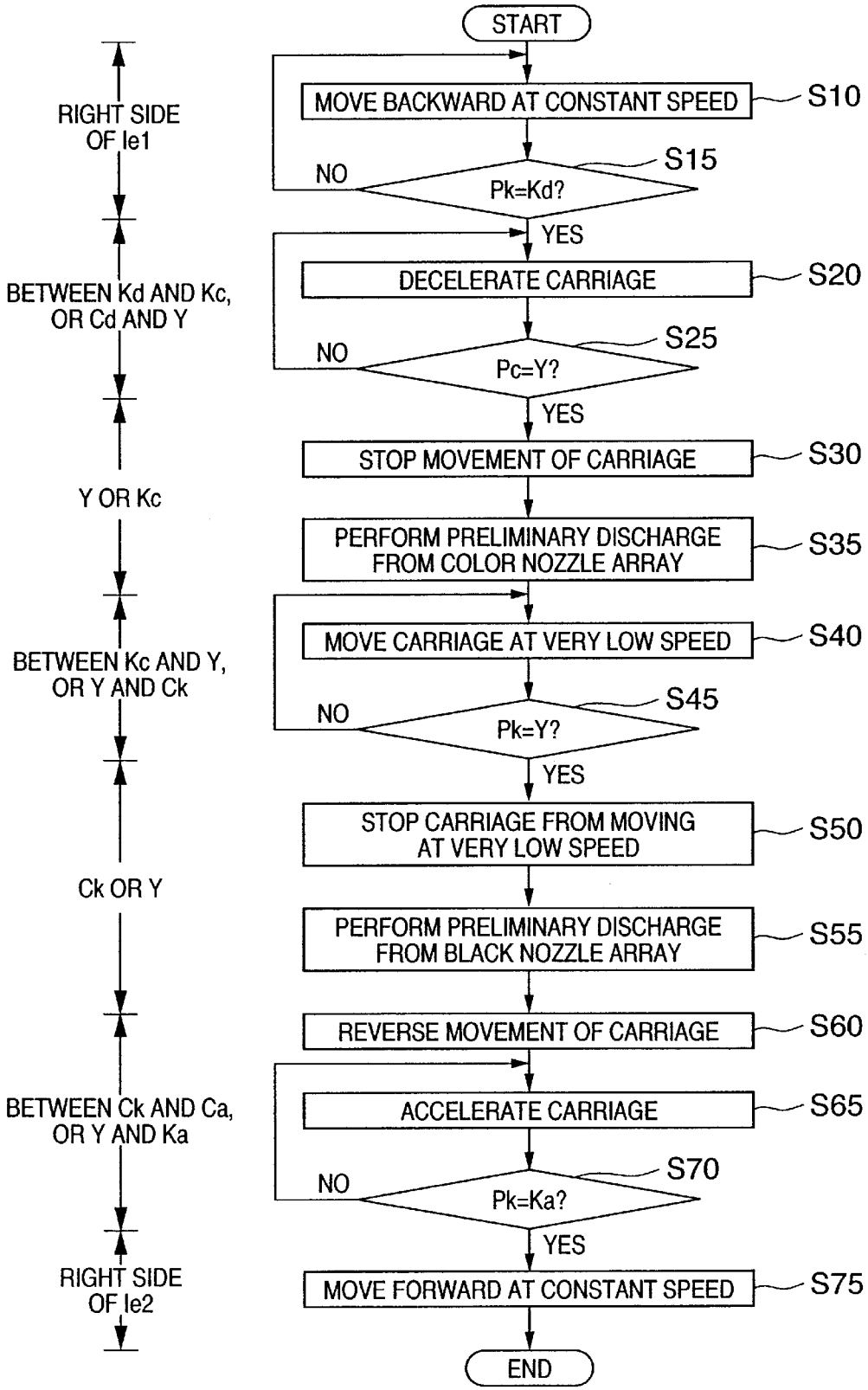
FIG. 6 is a flow chart showing carriage movement control and preliminary discharge control.

Carriage moving control and preliminary discharge control in this embodiment will be described below with reference to the flow chart shown in FIG. 6. Such control is performed by a CPU 400 which executes a program to control the operations of a head driving control circuit 415 and a carriage driving control circuit 416. The control will be described below, which is performed from the point where the carriage moves at a constant speed toward the home position while printing in the backward direction to the point where the moving direction of the carriage reverses and the carriage reaches a constant speed while moving away from the home position in the forward direction for printing.

In step S10, the carriage moves at the constant speed in the backward direction. In a constant speed movement zone on the right side (area I1) of Ie1, printing operation is performed using a black nozzle array 501 and a color nozzle array 502. In step S15, the CPU checks whether or not the position of the black nozzle array (Pk) has reached Kd in the x direction. If Pk=Kd, the flow advances to step S20. On the contrary, if Pk≠Kd, the flow returns to step S10, and the carriage keeps moving at the constant speed in the backward direction. Note that, if the position of the color nozzle array (Pc) has reached Kd, the color nozzle array 502 stops printing between Ie1 and Cd, and only moves at the constant speed.

In step S20, the carriage decelerates. In step S25, the CPU checks whether or not the position of the color nozzle array (Pc) has reached Y. If Pc=Y, the flow advances to step S30. If Pc≠Y, the flow returns to step S20, and the carriage keeps decelerating. Note that, if Pc=Y, then Pk=Kc.

In step S30, the carriage stops. In subsequent step S35, preliminary discharge is performed by the color nozzle array 502. When this preliminary discharged is completed, the carriage moves at a very low speed in the backward direction in step S40. In step S45, the CPU checks whether or not the position of the black nozzle array (Pk) has reached Y. If Pk=Y, the flow advances to step S50. If Pk≠Y, the flow returns to step S40, and the carriage keeps moving at a very low speed. Note that, if Pk=Y, then Pc=Ck.

In step S50, the movement of the carriage at the very low speed stops. In subsequent step S55, preliminary discharge is performed by the black nozzle array 501. When this preliminary discharged is completed, the moving direction of the carriage reverses from the backward direction to the forward direction, and the carriage accelerates in the forward direction in step S65.

In step S70, the CPU checks whether or not the position of the black nozzle array (Pk) has reached Ka. If Pk≠Ka, the flow returns to step S65, and the carriage keeps accelerating. If Pk=Ka, the flow advances to step S75. Note that, if Pk=Ka, the position of the color nozzle array has reached Ca, and the color nozzle array only moves at the constant speed between Ca and Ka.

In step S75, the acceleration of the carriage is stopped and the carriage is changed to move at a constant speed in the backward direction. After the black nozzle array 501 and the color nozzle array 502 have reached Ka, printing operation is performed. Note that, Ka=Ie2.

In accordance with the above embodiment, the interval between the ink receptor's position and the end portion of the print area can be used as the acceleration area of the carriage, while only the interval obtained by subtracting the interval between the black nozzle array and color nozzle array from the interval between the ink receptor's position and the end portion of print area can be used as the acceleration area in the prior art as shown in FIG. 8.

Therefore, in the inkjet printing apparatus where preliminary discharge is performed when the carriage movement is reversed on the home position side, the preliminary discharge is first performed by the nozzle array on the home position side and second performed by the nozzle array close to the print area, so that a sufficient acceleration area for stable movement of the carriage can be ensured without increasing the width of the apparatus. This also contributes to the downsizing of the inkjet printing apparatus.

Second Embodiment

In the first embodiment, the ink receptor is provided near the home position of the carriage as described above. In the second embodiment, a case will be described, in which another ink receptor is also provided outside the print area opposite to the home position in the main-scanning direction, and preliminary discharge is performed on the both sides of the print area. Note that since preliminary discharge operation using the ink receptor arranged on the home position side is the same as in the first embodiment, a description thereof will be omitted. In the second embodiment, the only preliminary discharge operation using the ink receptor arranged on the opposite side to the home position will be described.

Figure 7:
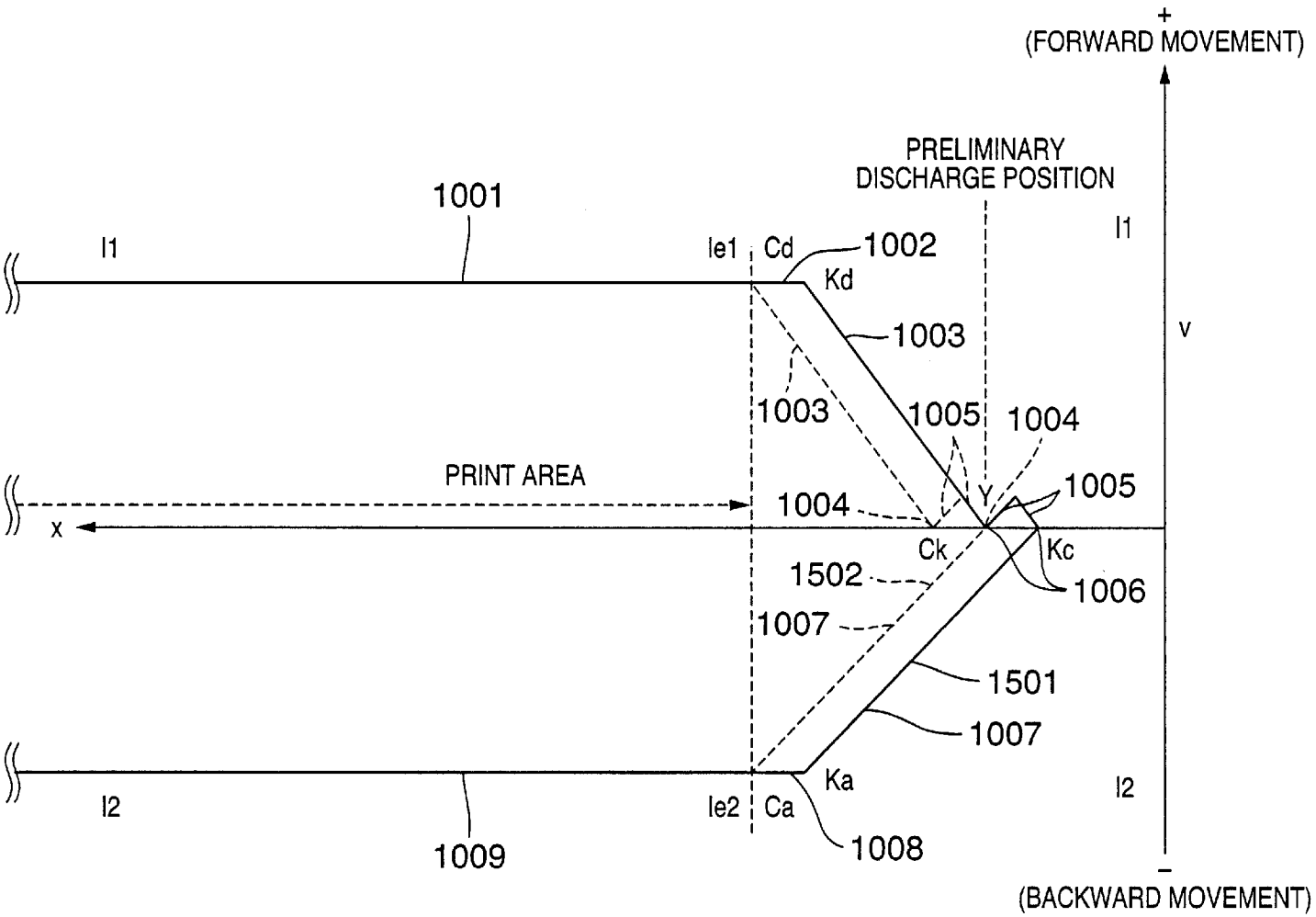
FIG. 7 is a view showing the relationship between the speed and the position of the printhead in the main-scanning direction in performing preliminary discharge when the carriage movement is reversed according to a second embodiment of the present invention.

FIG. 7 is a view showing the relationship between the speed and position of a printhead in the main-scanning direction in a case where preliminary discharge is performed when the carriage movement is reversed on the opposite side to the home position.

In FIG. 7, reference symbols/numerals x, v, 1501, 1502, I1, I2, Ie1, Ie2, Kd, Cd, Y, Ka, Ca, Ck, and Kc denote the same as those in FIGS. 5 and 8 described above, and a description thereof will be omitted. As is obvious from the arrangement of the printhead 102, the color nozzle arrays include the cyan, magenta, and yellow nozzle arrays, which simultaneously perform preliminary discharge. Hence, in FIG. 7, the position of the yellow nozzle array is indicated as the representative position of the color nozzle arrays.

The control will be described below, which is performed from the point where the carriage moves at a constant speed away from the home position while printing operation in the forward direction to the point where the moving direction of the carriage reverses and the carriage moves at a constant speed while moving toward the home position in the backward direction for printing.

1001. In a constant speed movement zone in the forward direction on the left side (area I1) of Ie1, printing operation is performed using a black nozzle array 501 and a color nozzle array 502.

1002. With regard to forward movement, as the carriage moves at the constant speed, the black nozzle array 501 moves from Ie1 to Kd.

1003. With regard to the forward movement, as the carriage decelerates, the black nozzle array 501 moves from Kd to Y, and the color nozzle array 502 moves from Cd to Ck.

1004. The carriage is stopped such that the black nozzle array 501 is positioned at Y and the color nozzle array 502 is positioned at Ck, and then preliminary discharge is performed by the black nozzle array 501.

1005. As the carriage moves at a very low speed in the forward direction, the color nozzle array 502 moves from Ck to Y, and the black nozzle array 501 moves from Y to Kc.

1006. The carriage is stopped such that the black nozzle array 501 is positioned at Kc and the color nozzle array 502 is positioned at Y, and then the preliminary discharge is performed by the color nozzle array 502.

1007. The moving direction of the carriage is reversed to the backward direction from this position. The carriage is then accelerated in the backward direction, the black nozzle array 501 moves from Kc to Ka, and the color nozzle array moves from Y to Ca (=Ie2).

1008. With respect to the backward movement, the movement of the carriage is changed to that at a constant speed. The black nozzle array 501 moves from Ka to Ie2. In this case, since the color nozzle array 502 has reached the end portion Ie2 of the print area, the color nozzle arrays 502 performs printing operation while moving at the constant speed.

1009. With regard to the backward movement, when the black nozzle array 501 reaches the end portion Ie2 of the print area, the black nozzle array 501 performs printing operation while moving at the constant speed.

Note that four-digit numbers 1001 to 1009 in the above description correspond to reference numerals 1001 to 1009 shown in FIG. 7.

In summary, in this embodiment, the ink receptors are arranged at the home position and the opposite position where the moving direction of the carriage is reversed, and preliminary discharge is performed at the both positions. On the home position side, preliminary discharge is performed in the order of the color nozzle array and the black nozzle array. On the contrary, on the opposite position to the home position, preliminary discharge is performed in the order of the black nozzle array and the color nozzle array.

Therefore, in accordance with the embodiment described above, the order of preliminary discharge is changed on both sides of the print area, i.e., the order of preliminary discharge is so changed as to perform preliminary discharge using the nozzle array arranged on the print area side at last. Therefore, the entire length between the ink receptor's position and the end portion of print area can be ensured as the acceleration area of the carriage.

Note that, in this embodiment, preliminary discharge for both the black nozzle array and color nozzle array is performed using the ink receptors arranged on both sides of the print area. However, the present invention is not limited to this. For example, preliminary discharge may be performed for only the color nozzle array on the home position side, and for only the black nozzle array on the opposite position to the home position, or vice versa.

In the embodiments described above, the arrangement is exemplified, where one printhead includes a plurality of nozzle arrays in the carriage moving direction. However, the present invention is not limited to this. For example, the present invention can be applied to a printing apparatus in which a plurality of printheads each having a plurality of nozzles arranged in a direction perpendicular/diagonal to the carriage moving direction are mounted on the carriage.

Additionally, in the embodiments described above, the printhead is exemplified, which includes two nozzle arrays for the sake of descriptive convenience. However, the present invention is not limited to this. A printhead including three or more nozzle arrays can also be used. For example, such a printhead may include four nozzle arrays for respectively discharging yellow, magenta, cyan, and black inks, which are arranged separately from each other. Preliminary discharge is performed by each nozzle array with respect to an ink receptor. In this case, with regard to the carriage reciprocal scanning area, preliminary discharge is controlled to be always performed from the nozzle array located outside the area to the nozzle array located inside it.

In this specification, "print" not only includes the formation of significant information such as characters and graphics, but also broadly includes the formation of images, figures, patterns, and the like on a printing medium, or the processing of the medium, regardless of whether they are significant or insignificant and whether they are so visualized as to be visually perceivable by humans.

Also, a "printing medium" not only includes a paper sheet used in common printing apparatuses, but also broadly includes materials, such as cloth, a plastic film, a metal plate, glass, ceramics, wood, and leather, capable of accepting ink.

Furthermore, "ink" (to be also referred to as a "liquid" hereinafter) should be extensively interpreted similar to the definition of "print" described above. That is, "ink" includes a liquid which, when applied onto a printing medium, can form images, figures, patterns, and the like, can process the printing medium, and can process ink (e.g., can solidify or insolubilize a coloring agent contained in ink applied to the printing medium).

The embodiment described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type and a continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

In addition, not only a cartridge type printhead in which an ink tank is integrally arranged on the printhead itself but also an exchangeable chip type printhead, as described in the above embodiment, which can be electrically connected to the apparatus main unit and can receive an ink from the apparatus main unit upon being mounted on the apparatus main unit can be applicable to the present invention.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

In addition, the ink-jet printer of the present invention may be used in the form of a copying machine combined with a reader, and the like, or a facsimile apparatus having a transmission/reception function in addition to an image output terminal of an information processing equipment such as a computer.

The present invention can be applied to a system constituted by a plurality of devices (e.g., host computer, interface, reader, printer) or to an apparatus comprising a single device (e.g., copy machine, facsimile).

Further, the object of the present invention can be also achieved by providing a storage medium storing program codes for performing the aforesaid processes to a system or an apparatus, reading the program codes with a computer (e.g., CPU, MPU) of the system or apparatus from the storage medium, then executing the program. In this case, the program codes read from the storage medium realize the functions according to the embodiments, and the storage medium storing the program codes constitutes the invention. Furthermore, besides aforesaid functions according to the above embodiments are realized by executing the program codes which are read by a computer, the present invention includes a case where an OS (operating system) or the like working on the computer performs a part or entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, CPU or the like contained in the function expansion card or unit performs a part or entire process in accordance with designations of the program codes and realizes functions of the above embodiments.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus for printing by discharging ink from an inkjet printhead to a printing medium by using the inkjet printhead on which a plurality of nozzle arrays each having a plurality of nozzles for discharging ink are arranged in a direction different from an array direction of the nozzles while reciprocally moving a carriage on which the inkjet printhead is mounted in a direction in which the plurality of nozzle arrays are arranged, comprising:

scanning means for reciprocally moving the carriage;

an ink receptor, being arranged on at least one end of a reciprocal movement area of the inkjet printhead, for receiving the ink discharged from the inkjet printhead;

preliminary discharge driving means for performing preliminary discharge from the inkjet printhead to said ink receptor when a carriage moving direction in the reciprocal movement is reversed by said scanning means;

scanning control means for controlling the carriage to stop in the preliminary discharge, accelerate from zero speed to a predetermined speed after the preliminary discharge is completed, and move at the predetermined speed; and control means for controlling movement of the carriage by said scanning means and the preliminary discharge performed by said preliminary discharge driving means such that the preliminary discharge is sequentially performed with regard to the plurality of nozzle arrays from a nozzle array arranged outside the reciprocal movement area to another nozzle array inside the area.

2. The apparatus according to claim 1, wherein said ink receptor is arranged near a home position of the carriage.

3. The apparatus according to claim 2, wherein another ink receptor is arranged on another end of the reciprocal movement area of the inkjet printhead, which is located on an opposite side to the home position.

4. The apparatus according to claim 3, wherein said control means so controls as to perform preliminary discharge from one of the plurality of nozzle arrays to said ink receptor arranged near the home position, and perform preliminary discharge from remaining nozzles of the plurality of nozzle arrays to said another ink receptor arranged on the opposite side to the home position.

5. The apparatus according to claim 1, wherein the plurality of nozzle arrays are nozzle arrays which respectively discharge different color inks.

6. The apparatus according to claim 1, wherein the inkjet printhead includes an electrothermal transducer for generating thermal energy to be applied to ink so as to discharge the ink by using the thermal energy.

7. The apparatus according to claim 1, wherein a print area in which the inkjet printhead performs printing operation by discharging the ink is formed inside the reciprocal movement area, and an interval between a position where the said receptor is arranged and one end of the print area is sufficient to accelerate the carriage to achieve the predetermined speed.

8. The apparatus according to claim 1, wherein a plurality of printheads each having a plurality of nozzles arranged in a direction perpendicular/diagonal to the carriage moving direction are mounted to the carriage.

9. A print control method adapted to a printing apparatus for printing by discharging ink from an inkjet printhead to a printing medium by using the inkjet printhead on which a plurality of nozzle arrays each having a plurality of nozzles for discharging ink are arranged in a direction different from an array direction of the plurality of nozzles while reciprocally moving a carriage on which the inkjet printhead is mounted in a direction in which the plurality of nozzle arrays are arranged and printing, and performing preliminary discharge from the inkjet printhead to an ink receptor arranged on at least one end of a reciprocal movement area of the inkjet printhead, comprising:

a preliminary discharge step of performing the preliminary discharge from the inkjet printhead to the ink receptor when a moving direction of the carriage is reversed;

a scanning control step of controlling the carriage to stop in the preliminary discharge, accelerate from zero speed to a predetermined speed after the preliminary discharge is completed, and move at the predetermined speed; and a control step of controlling movement of the carriage and the preliminary discharge performed at said preliminary discharge step such that the preliminary discharge is sequentially performed with regard to the plurality of nozzle arrays from a nozzle array arranged outside the reciprocal movement area to another nozzle array inside the area.

* * * * *

UNITED STATES PATENT AND TRADEMARK OFFICE

CERTIFICATE OF CORRECTION

PATENT NO. : 6,652,065 B2
DATED : November 25, 2003
INVENTOR(S) : Yoshinori Nakagawa It is certified that error appears in the above-identified patent and that said Letters Patent is hereby corrected as shown below:

Column 5,
Line 14, “sere” should read -- serve --.

Column 7,
Line 17, “(P)≡42.4 $\mu$m,” should read -- (P)≅42.4 $\mu$m, --

Column 8,
Line 39 and 49, “discharged” should read -- discharge --.

Column 10,
Line 17, “arrays 502” should read -- array 502 --.

Signed and Sealed this

Eighteenth Day of May, 2004

JON W. DUDAS
*Acting Director of the United States Patent and Trademark Office*